United States Patent [19]

Pridy et al.

[11] Patent Number: 4,778,359

[45] Date of Patent: Oct. 18, 1988

[54] ONE-PIECE CONNECTOR ASSEMBLY

[76] Inventors: Whetstine B. Pridy, 2411 Siskiyou Ave., Medford, Oreg. 97504; Sean M. Pridy, 7075 Lime Ave., Long Beach, Calif. 90805

[21] Appl. No.: 116,513

[22] Filed: Nov. 2, 1987

Related U.S. Application Data

[63] Continuation-in-part of Ser. No. 8,541, Jan. 29, 1987, abandoned.

[51] Int. Cl.[4] ..... F16B 1/00; F16B 11/00; F04B 47/02

[52] U.S. Cl. ..... 417/545; 403/291; 403/292

[58] Field of Search ..... 417/545; 403/491, 492

[56] References Cited

U.S. PATENT DOCUMENTS 1,907,522 5/1933 Eaton ..... 403/292

3,420,582 1/1969 Shelley ..... 403/291

3,597,938 8/1971 Hellon et al. ..... 403/291

*Primary Examiner*—William L. Freeh

*Attorney, Agent, or Firm*—Thomas I. Rozsa

[57] ABSTRACT

The present invention relates to an improved connector assembly which is made of one-piece design and construction with two sections that can move relative to each other to thereby provide a connector assembly which can pivotally connect the adjoining end portions of an upper and lower string of sucker rods that are angularly disposed relative to one another within a tubing string of like angulation. Through use of the present invention one-piece connector assembly, the string of sucker rods can be inserted through various dog-leg sections in the well bore hole and further are able to absorb longitudinal forces which may be exerted on the sucker rod strings thereby permitting the sucker rod strings to reciprocate without being subjected to stress from numerous frictional forces.

25 Claims, 3 Drawing Sheets

Fig. 6.
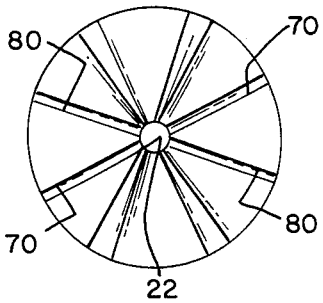
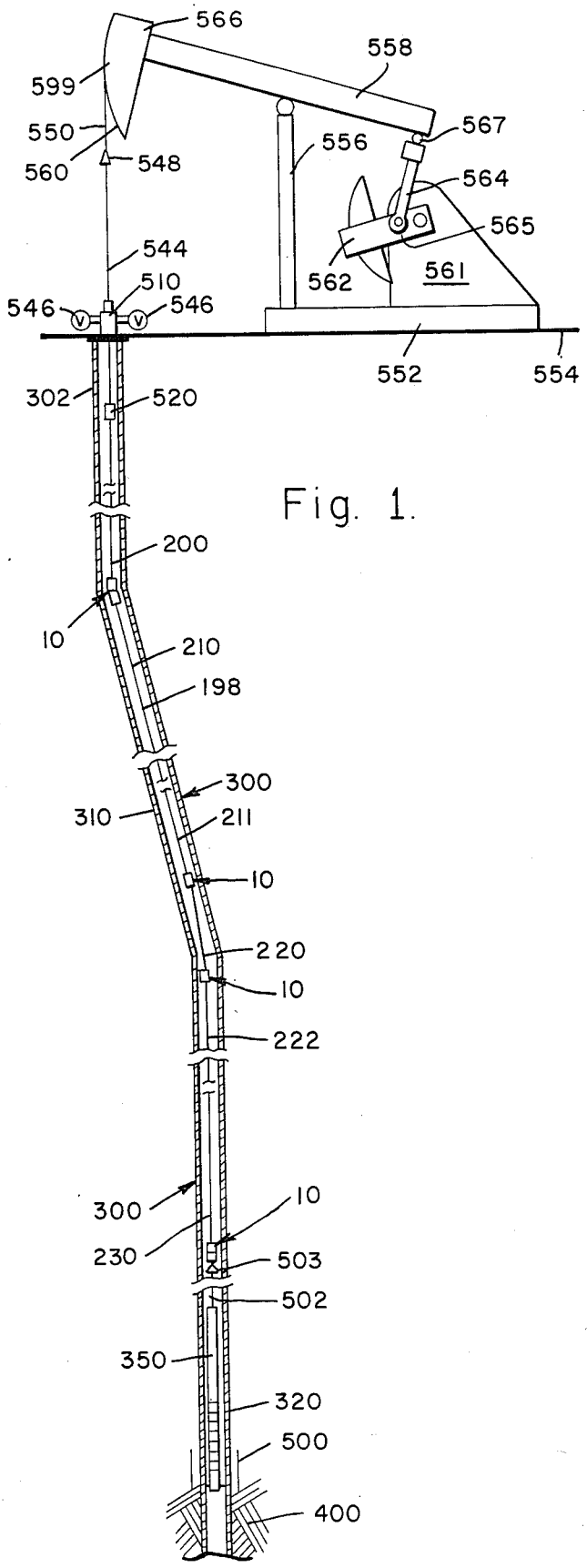
Fig. 1.
Fig. 2.
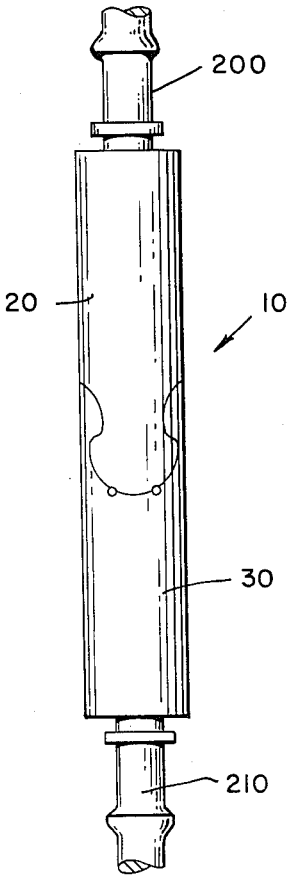

Fig. 8.
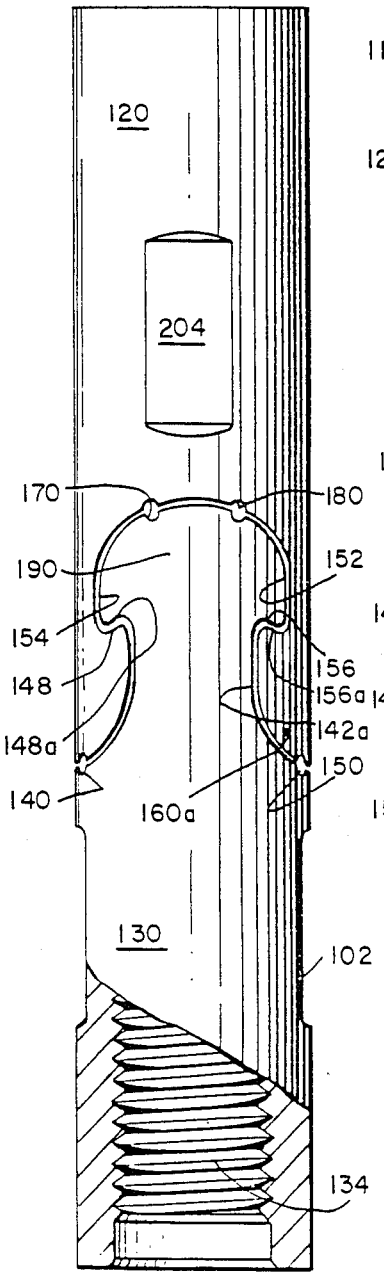
Fig. 7.
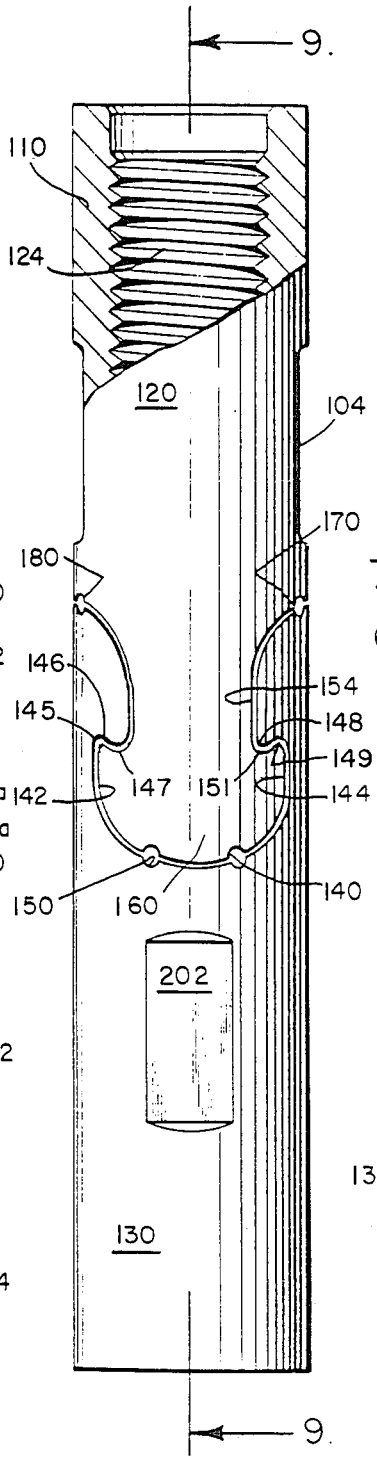
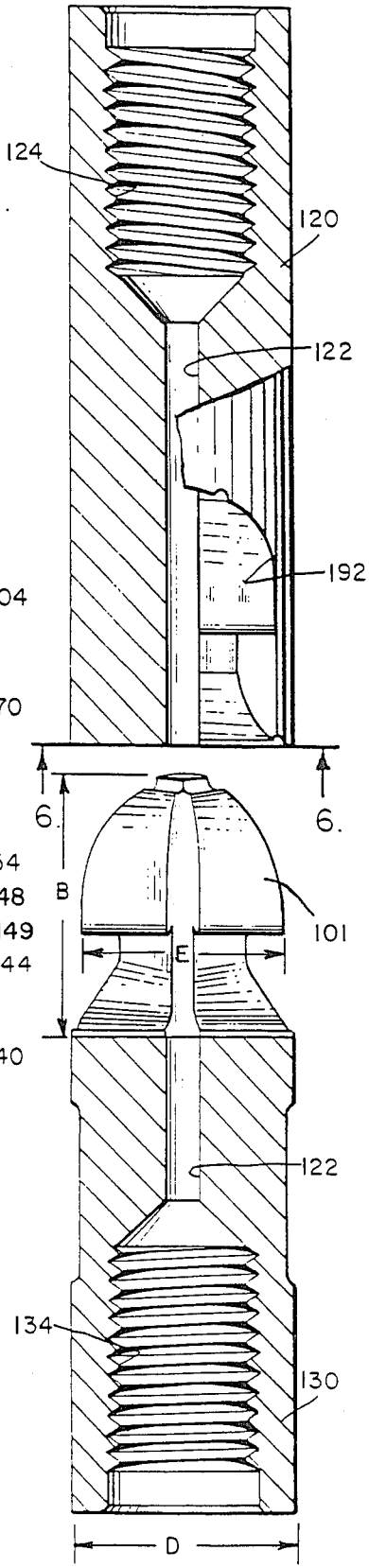
Fig. 9.

ONE-PIECE CONNECTOR ASSEMBLY

This is a continuation-in-part of co-pending application Ser. No. 008,541 filed Jan. 29, 1987, now abandoned.

BACKGROUND OF THE INVENTION

1. Field of the Invention

The present invention relates to an improved One-Piece Connector Assembly which is used to pivotally connect the adjoining end portions of a multiplicity of sucker rods that are angularly disposed relative to one another within a tubing string of like angulation.

2. Description of the Prior Art

Conventional oil well bore holes are dug into the ground from the surface to the location of the pool of oil or producing zone. Typically, such oil well bore holes that extend downwardly from the ground surface to the producing zone are not necessarily straight, but may be crooked, and have a number of dog-leg sections therein. Each of such bore holes has a well head at the surface that supports the tubing string. A polished rod that is reciprocated by conventional power means is connected to the upper end of a multiplicity of sucker rods which form a string that is connected to a reciprocating pump at the bottom of the tubing string. The tubing string has a number of angularly disposed sections therein that conform generally to the dog-leg sections of casing that will frequently be present in the bore hole.

The stationary portion of the reciprocating pump is connected with the lower end of the tubing string. A pull rod extends upwardly from the reciprocating portion of the pump, and the pull rod when reciprocated causes fluid from the producing zone to be discharged upwardly from the pump into the tubing string.

The polished rod is connected by a sequence of rods to the pull rod of the pump. The string of sucker rods are angularly disposed relative to one another. When the string of sucker rods is stressed longitudinally in actuating the pull rod of the pump, the string of sucker rods has been found to be subject to substantial friction.

Attempts have been made to solve this problem by creating a connector assembly which interconnects a pair of adjacent ends of two sucker rods such that the sucker rods can move relative to each other and can be bent at an angle relative to each other, thereby enabling the string of sucker rods to be reciprocated in the tubing string despite the numerous dog-leg bends and further enable the assembly to reduce the numerous longitudinal and lateral forces imparted to it. One such connector assembly is disclosed in U.S. Pat. No. 4,329,124 ("'124 Patent") issued to one of the present Inventors Whetstine B. Pridy. The Invention disclosed in the '124 Patent does work for a period of time but after a few weeks of being subjected to the forces imparted to the strings of sucker rod, the connector assembly described therein broke. Most often, the break occurred along the location of an internal shank identified as number 30 in the '124 Patent. A reason which has been postulated for this breakage was that the connector assembly of the '124 Patent is in two sections which are interconnected by the shank. While this is one reason the connector assembly is able to adjust to various angles and displacements, it also provides a point of weakness where the heavy stresses imparted to the connector assembly are focused.

A significant need therefore exists for an improved connector rod assembly which can interconnect adjacent ends of two sucker rods and which permits the string of rods to be reciprocated with reduced friction through a multiplicity of different dog-log sections in the tubing string.

SUMMARY OF THE INVENTION

The present invention relates to an improved connector assembly which is made of one-piece design and construction with two sections that can move relative to each other to thereby provide a connector assembly which can pivotally connect the adjoining ends of two sucker rods in a string of sucker rods that are angularly disposed relative to one another within a tubing string of like angulation. Through use of the present invention one-piece connector assembly, the string of sucker rods can be reciprocated through various dog-leg sections in the well bore hole and further are able to absorb longitudinal forces which may be exerted on the sucker rod strings thereby permitting the sucker rod strings to reciprocate without being subjected to excessive stress from numerous frictional forces.

It has been discovered, according to the present invention, that if a one-piece cylindrical object is machined into two sections which retain the one-piece nature of the structure but can move relative to each other, then the part eliminates a singular point of weakness which is subject to failure when subjected to continuous reciprocation with lateral and longitudinal forces. The part also enables the sections to absorb rotational forces.

It has also been discovered, according to the present invention, that if the adjoining portions of the two interconnecting sections are designed such that a portion of the mating members is in the shape of lobes a portion of which is hemispherical, the two sections can deviate relative to one another. It has further been discovered that a pair of oppositely disposed hemispherical sections creates a generally "S" shaped configuration which creates an interlocking pattern to thereby eliminate a tendency of the two sections to pop out relative to one another.

It has further been discovered, according to the present invention, that if the hemispherical portions are generally mushroom shaped to thereby create a pair of inwardly disposed transverse ledges, the transverse ledges provide tensile strength and prevents the parts from pulling apart when subjected to longitudinal pulling forces.

It has additionally been discovered, according to the present invention, that if the pair of inwardly disposed transverse ledges of the hemispherical portions are in turn curved in a generally "S" shaped pattern, then this additional interlocking "S" shape serves to substantially reduce the internal sharp end in designs not embodying the interlocking "S" shaped transverse ledges and thereby eliminates a point of weakness where the interlocking hemispherical lobes may be torn apart when subjected to continuous and heavy lateral and torsional forces.

It also has been discovered, according to the present invention, that if the two interconnecting parts have a pair of adjoining vertical necks, the vertical necks provide torque strength and greatly assist in enabling the part to withstand torsional loads.

It has been discovered that when a part as described above has been used to interconnect adjacent sucker rods, in addition to withstanding all the forces, the connector substantially reduces the friction of the moving assembly in the tubing string so that the reciprocating portion of the pump has increased travel resulting in substantially more barrels of oil being pumped out in a given period of time.

It has further been discovered that an interconnecting assembly as described above can be machined into a one piece stock of cylindrical material such as steel through a process called electro discharge machining. In this process, a conductive wire charged with electrical current sufficient to create a magnetic field which destroys the metal bond between the steel molecules is run in a selected pattern and therefore acts as a saw. The wire is manipulated through the pattern to thereby facilitate the cut.

It is therefore an object of the present invention to provide a connector assembly that can removably join adjacently disposed but longitudinally spaced end portions of two sucker rods in a string of sucker rods that are subject to angular disposition to one another in a manner such that substantial longitudinal stresses may be transmitted from one sucker rod to the other without the sucker rod being subjected to excessive friction.

It is a further object of the present invention to provide a connector assembly which permits the string of sucker rods to move within the tubing string with significant ease to thereby substantially reduce the friction generated by the moving assembly and thereby cause increased travel of the reciprocating portion of the pump thereby permitting more oil to be pumped out of the well for a given period of time.

It is another object of the present invention to provide connector assemblies which facilitate connecting the lower end of the lowermost sucker rod to the pull rod of the reciprocating pump situated at the lower end of the tubing string by attaching a connector assembly to a pony rod which in turn is connected to the pump.

It is a further object of the present invention to provide a connector assembly to join adjacently disposed but longitudinally spaced end portions of sucker rods in a string of sucker rods such that the string of sucker rods and the pull rod when so connected by the connector assemblies of the present invention permit the sucker rods and pump to reciprocate within a tubing string having a number of longitudinally spaced angulations therein without difficulty and further connect the lowermost sucker rod to the pull rod of the reciprocating pump (through a pony rod).

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a side elevational view of a number of the connector assemblies utilized to join adjacent ends of two of angularly disposed sucker rods positioned in a tubing string of substantially like angulation, with the connector assemblies permitting a power actuated polished rod to reciprocate the sucker rod string to actuate the pull rod of a pump with reduced friction.

FIG. 2 is a fragmentary side elevational view of a connector assembly of the present invention removably joining longitudinally spaced end portions of two sucker rods.

FIG. 6 is a cross-sectional view of the connector assembly taken along line 6—6 of FIG. 5 and looking up into the cavity in which a lobe is housed.

FIG. 7 is a side elevational view of an alternative embodiment of the present invention connector assembly with a portion broken away to show the upper internal threaded shaft.

FIG. 8 is a side elevational view of the embodiment of the present invention connector assembly with the connector assembly rotated counterclockwise ninety degrees from the view shown in FIG. 7, with a portion broken away to show the lower internal threaded shaft.

FIG. 9 is a cross-sectional view of one embodiment of the connector assembly taken along line 9—9 of FIG. 3, with the two sections artificially separated to better illustrate the internal parts of the connector assembly.

DETAILED DESCRIPTION OF THE PREFERRED EMBODIMENT

Figure 4:
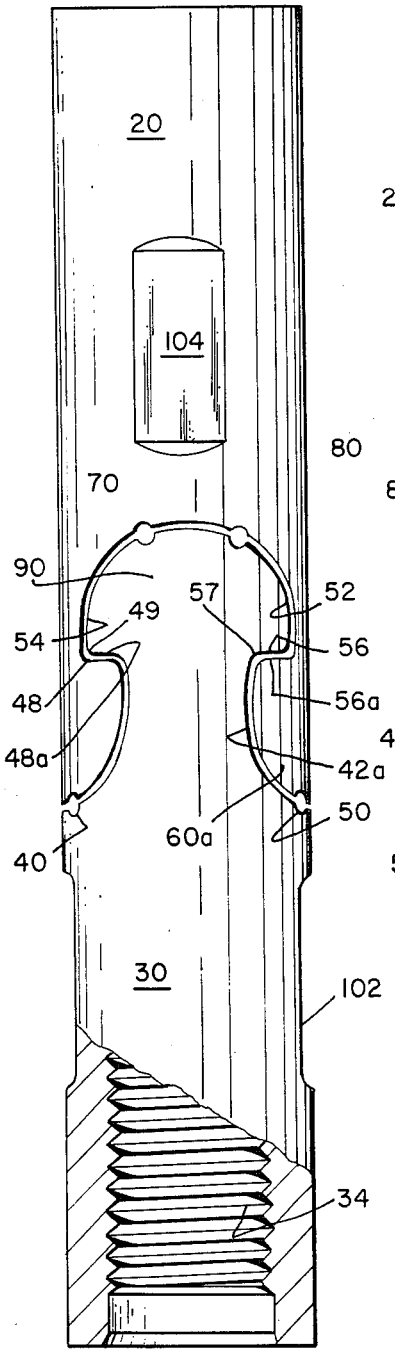
FIG. 4 is a side elevational view of one embodiment of the present invention connector assembly with the connector assembly rotated counterclockwise ninety degrees from the view shown in FIG. 3, with a portion broken away to show the lower internal threaded shaft.

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring to FIG. 2, one embodiment of the present invention one piece connector assembly is shown at 10. To more fully understand how the connector assembly 10 is positioned in its operative position, a detailed diagrammatic view of the connector assembly 10 in operation is shown in FIG. 1. Referring to FIG. 1, a sucker rod string 198 is shown inside tubing string 300. One connector assembly 10 is shown connecting a first sucker rod 200 to a second sucker rod 210 of sucker rod string 198. The first and second sucker rods 200 and 210 are shown in FIG. 1 disposed in a tubing string 300 that has first and second portions 302 and 310 that are angularly disposed relative to one another. In FIG. 1, another connector assembly 10 connects sucker rod 211 to sucker rod 220 of sucker rod string 198 and another connector assembly 10 connects sucker rod 220 to sucker rod 222. Sucker rods conventionally are either 25 or 30 feet long. In the illustration shown in FIG. 1, there may be any multiplicity of sucker rods connected in each straight length of tubing string, depending upon the length of that section of tubing string. The second portion of tubing string 310 is connected to and angularly disposed relative to third tubing string 320.

Further referring to FIG. 1, a reciprocating pump 350 is shown situated below the lower end of sucker rod string 198, which pump is in communication with a fluid producing zone 400 that has a bore hole 500 extending upwardly therefrom to a well head 510. The pump 500 includes a reciprocating pull rod 502 connected to a pony rod 503 that is joined to the lowermost end of lowermost sucker rod 230 by a connector assembly 10.

Therefore, as shown in operation in FIG. 1, a number of connector assemblies 10 is utilized to join adjacent ends of angularly disposed sucker rods (200, 210, 211, 220, 222 and 230) which form a sucker rod string 198 positioned in a tubing string 300 (including elements 302, 310 and 320) of substantially like angulation, with the connector assemblies 10 permitting a power actuated polished rod 544 to reciprocate the sucker rod string to actuate the pull rod 502 of a pump 500.

The upper end of sucker rod string 198 is connected by a fitting 520 to the lower end of a polished rod 544 that is slidably movable through the well head assembly 510. The upper end of the polished rod 544 is connected by a carrier bar 548 to the lower end of a conventional cable. The well head assembly 510 has one or more valved fluid outlets 546 as a part thereof through which fluid is discharged from the upper part of the tubing string 300.

A base 552 is provided that is supported at a fixed position on the ground surface 554, with the base having a post 556 standing upwardly therefrom that has a pivotal mounting 557 on the upper end thereof that supports an elongate beam 558. The beam 558 has a head 559 on which a convex surface 560 is defined. The cable 550 extends upwardly over the convex surface 560 and is secured to the upper part of the head 559 by an anchor 566 as shown in FIG. 1.

The base 552 supports a prime mover in the form of a motor or engine 561 that drives a counterweighted arm 562 that has a connecting rod 564 pivotally connected thereto at 565. A pivotal connection 567 joins the connecting rod 564 to the beam 558.

Figure 3:
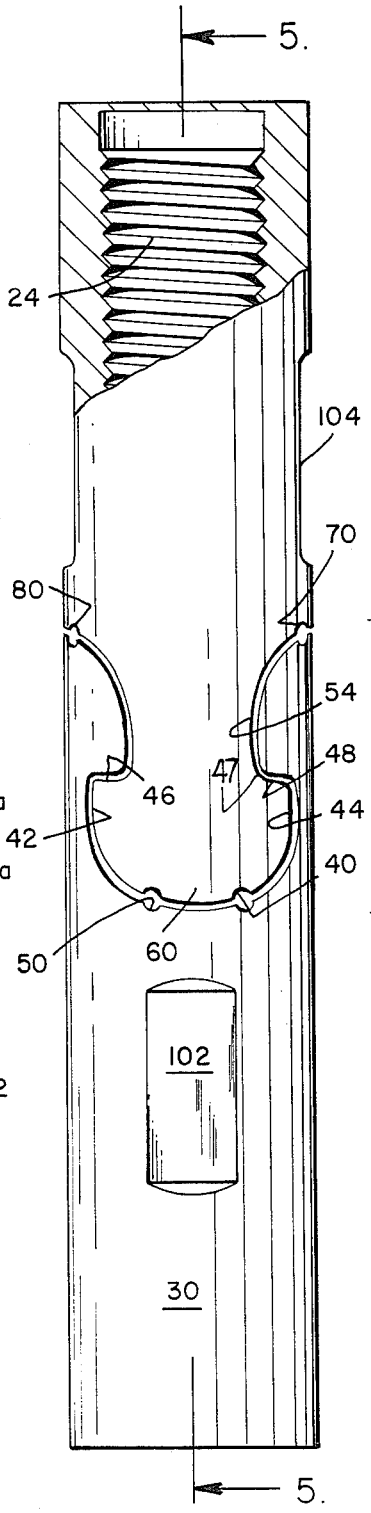
FIG. 3 is a side elevational view of one embodiment of the present invention connector assembly with a portion broken away to show the upper internal threaded shaft.

Having thus described the general purpose and operation of the connector assembly, the detailed description of the present invention one piece connector assembly 10 will now be presented. Referring first to FIGS. 2 and 3, the one piece connector assembly is shown at 10. In this embodiment, the connector assembly 10 is cylindrical in design and is comprised of two sections 20 and 30 which can can be angularly and torsionally disposed relative to one another. Sections 20 and 30 are essentially identical but are inverted and offset ninety degrees to one another (as can be seen by comparing FIGS. 3 and 4) to thereby interlock with one another.

Figure 5:
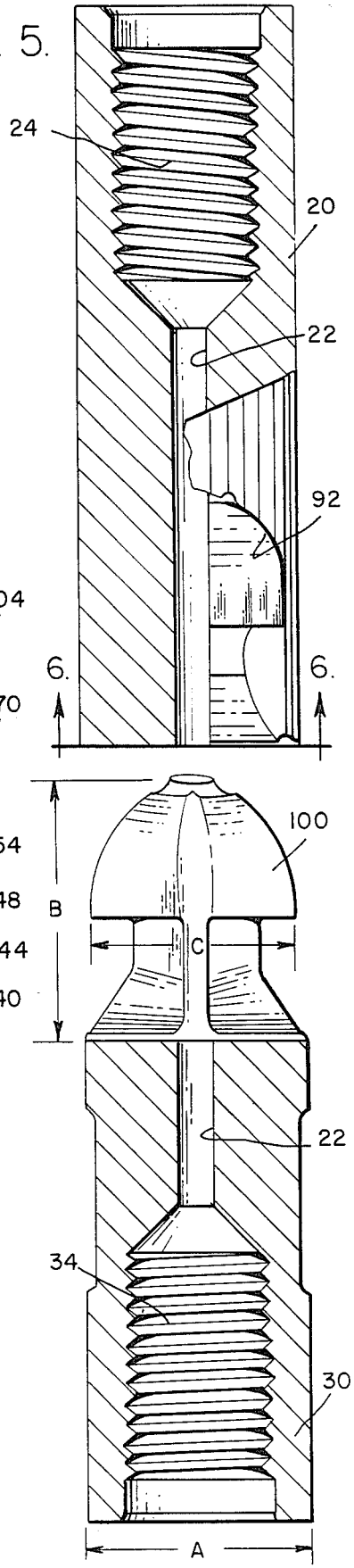
FIG. 5 is a cross-sectional view of one embodiment of the connector assembly taken along line 5—5 of FIG. 3, with the two sections artificially separated to better illustrate the internal parts of the connector assembly.

In order to best illustrate the internal portion of the present invention connector assembly 10, an artificial cross-sectional view is shown in FIG. 5. The view is artificial because in reality the two sections 20 and 30 cannot be broken apart. The cross-sectional view is taken along line 5—5 of FIG. 3. In forming the one piece connector assembly 10, the operation is started with a single cylindrical piece of metal such as steel. By way of example, for a nominal three quarter inch sucker rod string, the piece can be approximately eight and a half inches long and one and five-eighths inches wide. The following table is illustrative of part dimensions for different sucker rod strings:

| Sucker Rod String Diameter | Connector Assembly Length | Connector Assembly Width |
|---|---|---|
| $\frac{3}{4}$ inch | $8\frac{1}{2}$ inches | $1\frac{5}{8}$ inches |
| $\frac{7}{8}$ inch | $8\frac{1}{2}$ inches | $1\frac{7}{8}$ inches |
| 1.0 inch | $8\frac{1}{2}$ inches | 2.0 inches |

A central shaft 22 is bored through the center of the block and extends through the entire length of section 20 and 30. By way of example, the shaft 22 can be approximately one-eighth of an inch in diameter to one-quarter of an inch in diameter. A wider internal threaded shaft 24 is machined into section 20 to provide a threaded female coupling member to accommodate the threaded end of a sucker rod. A comparable internal threaded shaft 34 is machined into the end of section 30. The threaded shafts 24 and 34 are standard API (American Petroleum Institute) threaded shafts and by way of example can be $\frac{3}{4}''$ API Sucker Rod Thread, $\frac{7}{8}''$ API Sucker Rod Thread or 1" API Sucker Rod Thread.

The two sections 20 and 30 of the connector assembly 10 are formed through the following machining operation. Through a process called electro discharge machining ("EDM"), a conductive wire is charged with electrical current sufficient to create a magnetic field which destroys the metal bond between the steel molecules and therefore acts as a saw. FIG. 6 is a transverse cross-sectional view taken along line 6—6 of FIG. 5. In operation (referring to FIGS. 3, 4 and 6), a first transverse hole 40 is machined through the entire thickness of connector assembly 10 and a second transverse hole 50 is also machined through the entire thickness of connector assembly 10. The holes intersect in the center of connector assembly 10 and are offset to form an approximate twenty two and one-half degree angle relative to each other. A second pair of transverse holes 70 and 80 are drilled into section 20 at a location approximately ninety degrees to the first two holes. That is, transverse hole 70 is approximately 90 degrees to transverse hole 50 and transverse hole 80 is approximately 90 degrees to transverse hole 40. Comparing FIGS. 3 and 4 and keeping in mind that all of the holes extend through the entire diameter of the connector assembly 10, it is clear that each opening is offset by approximately twenty-two and one half degrees relative to an adjacent opening with two openings located on each of the four ninety degree arcs of the cylindrical body of the connector assembly 10. Through use of the electro discharge machining process, a wire is inserted through one transverse hole and is charged with electricity sufficient to create the magnetic field to break the steel molecule bonds and cause the wire to act like a saw. The charged wire is then guided through the preset pattern to create the pattern shown in FIGS. 3 and 4. The pattern is simultaneously cut through two oppositely disposed faces in the connector assembly. Referring first to FIG. 3, assuming the pattern is started through opening 50, moving clockwise, the lower left portion of hemisphere 60 is machined through connector assembly 10 to form an arc whose radius is approximately one inch and thereafter a first vertical wall portion 42 is machined into the connector assembly 10. The vertical wall 42 is then rounded into a transverse ledge 46 which extends inwardly by approximately one-quarter of an inch. Re-inserting the wire through opening 50 and moving counterclockwise, the top of hemispherical portion 60 is machined through the connector assembly 10. The wire is then passed through opening 40 and the pattern continued to form the right portion of hemisphere 60 to thereby complete a hemisphere with an arc whose radius is approximately one inch. Thereafter, a second vertical wall 44 is machined in the connector assembly 10. The vertical wall 44 is then rounded into a transverse ledge 48 which extends inwardly by approximately one-quarter of an inch. Ledge 48*a* of hemispherical member 90 is simultaneously formed. Following the generally "S" shaped pattern, vertical wall 54 is machined and thereafter curved to begin the formation of hemispherical member 90. Alternatively, the charged wire is inserted through hole 70 and the wire moved clockwise to create the left portion of the arc of hemisphere 90 and then to create vertical wall 54 until it joins ledge 48*a*. The charged wire is then passed over the top portion of the hemisphere 90 and thereafter through hole 80 to machine the right portion of the arc of hemisphere 90 and thereafter to create vertical wall 52. The wire is then moved along the pattern to create transverse ledge 56. The wire is then moved to create vertical wall 42*a* and thereafter is moved to create the opposite arcuate side of hemispherical portion 60, a part of which is shown as 60*a* in FIG. 4.

It is emphasized that the particular charged wire movement just described is merely illustrative of one of many alternative routes that can be taken. Since the wire extends through the entire diameter of the connector assembly, oppositely disposed portions are cut simultaneously. The complete part is comprised of a pair of oppositely disposed hemispherical portions which resemble hemispherical portion 60, its pair of oppositely disposed vertical walls 42 and 44 and its pair of inwardly extending transverse ledges 48 and 46. Offset by ninety degrees to this pair of oppositely disposed hemispherical portions is a pair of oppositely disposed hemispherical portions which resemble hemispherical portion 90, its pair of oppositely disposed vertical walls 54 and 52 and its pair of inwardly extending transverse ledges 48 and 56. Adjacent hemispheres are mirror images of one another offset by ninety degrees and have an oppositely disposed inwardly extending transverse wall. For example, as shown in FIGS. 3 and 4, hemispheres 60 and 90 have oppositely disposed transverse walls 48 and 48*a* respectively. Hemispheres 90 and 60*a* have oppositely disposed transverse walls 56 and 56*a* respectively.

The result of this electro discharge machining process is to create two pair of offset arcuate lobes that are slit down the middle by shaft 22 and which are interlocked and offset ninety degrees to each other. When viewed from the side, the general configuration is that of a hemisphere, as shown in FIGS. 3 and 4 with an upper arcuate surface and a generally flat lateral lower surface as shown in FIG. 5. A portion of a lateral surface of a lobe from one section lies directly opposite a portion of the lateral surface of an adjacent lobe from the other section. In the preferred embodiment, the radius of the hemisphere is approximately one inch. The total longitudinal dimension of the two adjacent hemispheres as shown by dimension "B" in FIG. 5 is therefore approximately two inches. The actual shape of the lobe is shown in FIG. 5. One such lobe is numbered 100 in FIG. 5 and is composed of hemispherical portion 90 and its cut inwardly extending part. This lobe has an opposite counterpart (not shown). The lobe 100 which is part of lower section 30 fits within cavity 92 which lies within upper section 20. The oppositely disposed lobe is also a part of section 30 and fits within cavity 92. It will be appreciated that section 20 also contains a pair of lobes which are mirror images to the lobes of section 30 and offset by ninety degrees to them, being composed of hemispherical portions 60 and 60*a* respectively and their respective inwardly extending portions. The lobes of section 20 fit into a corresponding cavity in section 30. The two pairs of lobes are capable of moving relative to one another due to the slack created by the interlocking parts, the central shaft 22 running through the longitudinal length of the connector assembly, and the gap between the surface of each hemisphere and the body of the connector assembly. In the case of a preferred embodiment where the diameter of the connector assembly as shown by dimension "A" in FIG. 5 is approximately one and five eighths inches (for $\frac{3}{4}$ inch sucker rod), the diameter of the bottom of lobe 100 as shown by dimension "C" is approximately one and three eighths inches.

As a result of the design, the two hemispheres are interlocked so that the connector assembly is essentially of one piece construction but has two separate sections which can move relative to each other to thereby permit the connector assembly to adjust to various arcuate bends and dog-leg portions in the tubing string. The transverse ledges such as 46, 48, and 56 provide a substantial tensile force strength to counteract all of the longitudinal forces imparted to the connector assembly 10 and thereby prevent the two sections 20 and 30 from being pulled apart. The tops of the hemispheres provide substantial compression strength to prevent the two sections 20 and 30 from being compressed together. The vertical walls such as 42, 44, 54, 52 and 42*a* provide for significant rotational or torque strength to absorb the twisting and torsional forces imparted to the apparatus. The interlocking nature of the two internal hemispheres provides an assembly which permits the two sections to move in an arcuate manner relative to each other while at the same time distributing the lateral and torsional forces over the entire arcuate member and not permitting the forces to concentrate in one selected area. As a result, this present design eliminates a point of weakness location where the connector assembly can break.

Because of the hemispherical shape, the transverse ledges have more surface area on their outer side than in the center. Therefore, when pulling forces are exerted on the connector assembly, any shearing that may result will begin on the inside and this could lead to the two sections being pulled apart. The interlocking "S" shaped pattern of adjacent hemispheres tends to eliminate the shearing of the interior surface of the ledge and therefore tends to reduce the incidence of the two parts being pulled apart.

The central hole 22 is important to allow relative movement of the two sections and their respective lobes.

In experimental use, the present invention connector assembly 10 has been able to withstand fifty three tons of straight pull. In addition, the design has eliminated friction of the string of connector rods in the tubing string such that nearly twenty-four additional barrels of oil each day have been pumped from a well using the connector assembly 10 to interconnect sucker rods.

Through experimental use, it has been discovered that the embodiment of the present invention as described above may have a point of weakness due to the sharp angle created that the intersection of the transverse ledge and the vertical wall portion of the lobes.

By way of example, point 49 which is the intersection of transverse ledge 48*a* and vertical wall 54 is one such sharp intersection point. Point 47 which is the intersection of transverse ledge 48 and vertical wall 44 is another such point. Point 57 which is the intersection of transverse ledge 56 and vertical wall 42*a* is another such point. It will be appreciated that such points occurs at each intersection point. Therefore, in an alternative embodiment of the present invention, these sharp intersection points are eliminated through the additional design of an arcuate transverse wall in a generally "S" shaped pattern to create a curved or arcuate surface rather than a sharp edge at the intersection points of the transverse wall and the vertical wall.

The alternative embodiment of the present invention will now be described. Referring first to FIG. 7, the alternative embodiment of the one piece connector assembly is shown at 110. In this embodiment, the connector assembly 110 is cylindrical in design and is comprised of two sections 120 and 130 which can can be angularly and torsionally disposed relative to one another. Sections 120 and 130 are essentially identical but are inverted and offset ninety degrees to one another (as can be seen by comparing FIGS. 7 and 8) to thereby interlock with one another.

In order to best illustrate the internal portion of the alternative embodiment of the present invention connector assembly 110, an artificial cross-sectional view is shown in FIG. 9. The view is artificial because in reality the two sections 120 and 130 cannot be broken apart. The cross-sectional view is taken along line 9—9 of FIG. 7. In forming the one piece connector assembly 110, the operation is started with a single cylindrical piece of metal such as steel. By way of example, for a nominal three quarter inch sucker rod string, the piece can be approximately eight and a half inches long and one and five-eighths inches wide. The following table is illustrative of part dimensions for different sucker rod strings:

| Sucker Rod String Diameter | Connector Assembly Length | Connector Assembly Width |
|---|---|---|
| $\frac{3}{4}$ inch | $8\frac{1}{2}$ inches | $1\frac{5}{8}$ inches |
| $\frac{7}{8}$ inch | $8\frac{1}{2}$ inches | $1\frac{7}{8}$ inches |
| 1.0 inch | $8\frac{1}{2}$ inches | 2.0 inches |

A central shaft 122 is bored through the center of the block and extends through the entire length of section 120 and 130. By way of example, the shaft 122 can be approximately one-eighth of an inch in diameter to one-quarter of an inch in diameter. A wider internal threaded shaft 124 is machined into section 120 to provide a threaded female coupling member to accommodate the threaded end of a sucker rod. A comparable internal threaded shaft 134 is machined into the end of section 130. The threaded shafts 124 and 134 are standard API (American Petroleum Institute) threaded shafts and by way of example can be $\frac{3}{4}$" API Sucker Rod Thread, $\frac{7}{8}$" API Sucker Rod Thread or 1" API Sucker Rod Thread.

The two sections 120 and 130 of the connector assembly 110 are formed through the following machining operation. Through a process called electro discharge machining ("EDM"), a conductive wire is charged with electrical current sufficient to create a magnetic field which destroys the metal bond between the steel molecules and therefore acts as a saw. In operation (referring to FIGS. 7 and 8), a first transverse hole 140 is machined through the entire thickness of connector assembly 110 and a second transverse hole 150 is also machined through the entire thickness of connector assembly 110. The holes intersect in the center of connector assembly 110 and are offset to form an approximate twenty two and one-half degree angle relative to each other. A second pair of transverse holes 170 and 180 are drilled into section 120 at a location approximately ninety degrees to the first two holes. That is, transverse hole 170 is approximately 90 degrees to transverse hole 150 and transverse hole 180 is approximately 90 degrees to transverse hole 140. Comparing FIGS. 7 and 8 and keeping in mind that all of the holes extending through the entire diameter of the connector assembly 110, it is clear that each opening is offset by approximately twenty-two and one half degrees relative to an adjacent opening with two openings located on each of the four ninety degree arcs of the cylindrical body of the connector assembly 110. Through use of the electro discharge machining process, a wire is inserted through one transverse hole and is charged with electricity sufficient to create the magnetic field to break the steel molecule bonds and cause the wire to act like a saw. The charged wire is then guided through the preset pattern to create the pattern shown in FIGS. 7 and 8. The pattern is simultaneously cut through two oppositely disposed faces in the connector assembly. Referring first to FIG. 7, assuming the pattern is started through opening 150, moving clockwise, the lower left portion of hemisphere 160 is machined through connector assembly 110 to form an arc whose radius is approximately one inch and thereafter a first vertical wall portion 142 is machined into the connector assembly 110. The vertical wall 42 is then rounded into a transverse ledge 146 which extends inwardly by approximately one-quarter of an inch. Transverse ledge 146 is arcuate and is in a generally "S" shaped pattern with an upper arc portion 145 and a lower arc portion 147 to thereby provide a rounded intersection point between the transverse ledge and the vertical wall and thereby eliminating the sharp intersection points found in the first embodiment of the present invention as previously described. Re-inserting the wire through opening 150 and moving counterclockwise, the top of hemispherical portion 160 is machined through the connector assembly 110. The wire is then passed through opening 140 and the pattern continued to form the right portion of hemisphere 160 to thereby complete a hemisphere with an arc whose radius is approximately one inch. Thereafter, a second vertical wall 144 is machined in the connector assembly 110. The vertical wall 144 is then rounded into a transverse ledge 148 which extends inwardly by approximately one-quarter of an inch. Transverse ledge 148 is arcuate and is in a generally "S" shaped pattern with an upper arc portion 149 and a lower arc portion 151 to thereby provide a round intersection point between the transverse ledge and the vertical wall and thereby eliminating the sharp intersection points found in the first embodiment of the present invention as previously described. Ledge 148*a* of hemispherical member 190 is simultaneously formed. Following the generally "S" shaped pattern, vertical wall 154 is machined and thereafter curved to begin the formation of hemispherical member 190. Alternatively, the charged wire is inserted through hole 170 and the wire moved clockwise to create the left portion of the arc of hemisphere 190 and then to create vertical wall 154 until it joins ledge 148*a*. The charged wire is then passed over the top portion of the hemisphere 190 and thereafter through hole 180 to machine the right portion of the arc of hemisphere 190 and thereafter to create vertical wall 152. The wire is then moved along the pattern to create transverse ledge 156 which is also in an arcuate "S" pattern. The wire is then moved to create vertical wall 142*a* and thereafter is moved to create the opposite arcuate side of hemispherical portion 160, a part of which is shown as 160*a* in FIG. 8.

It is emphasized that the particular charged wire movement just described is merely illustrative of one of many alternative routes that can be taken. Since the wire extends through the entire diameter of the connector assembly, oppositely disposed portions are cut simultaneously. The complete part is comprised of a pair of oppositely disposed hemispherical portions which resemble hemispherical portion 160, its pair of oppositely disposed vertical walls 142 and 144 and its pair of inwardly extending arcuate generally "S" shaped transverse ledges 148 and 146. Offset by ninety degrees to this pair of oppositely disposed hemispherical portions is a pair of oppositely disposed hemispherical portions which resemble hemispherical portion 190, its pair of oppositely disposed vertical walls 154 and 152 and its pair of inwardly extending arcuate generally "S" shaped transverse ledges 148 and 156. Adjacent hemispheres are mirrior images of one another offset by ninety degrees and have an oppositely disposed inwardly extending transverse ledge. For example, as shown in FIGS. 7 and 8, hemispheres 160 and 190 have oppositely disposed transverse ledges or walls 148 and 148*a* respectively. Hemispheres 190 and 160*a* have oppositely disposed transverse ledges or walls 156 and 156*a* respectively.

The result of this electro discharge machining process is to create two pair of offset arcuate lobes that are slit down the middle by shaft 122 and which are interlocked and offset ninety degrees to each other. When viewed from the side, the general configuration is that of a hemisphere, as shown in FIGS. 7 and 8 with an upper arcuate surface and a generally flat lateral lower surface as shown in FIG. 9 (from the outside the lateral or transverse surface is arcuate and generally "S" shaped but appears flat when cut across the center line). A portion of a lateral surface of a lobe from one section lies directly opposite a portion of the lateral surface of an adjacent lobe from the other section. In the preferred embodiment, the radius of the hemisphere is approximately one inch. The total longitudinal dimension of the two adjacent hemispheres as shown by dimension "B" in FIG. 9 is therefore approximately two inches. The actual shape of the lobe is shown in FIG. 9. One such lobe is numbered 101 in FIG. 9 and is composed of hemispherical portion 190 and its cut inwardly extending part. This lobe has an opposite counterpart (not shown). The lobe 101 which is part of lower section 130 fits within cavity 192 which lies within upper section 120. The oppositely disposed lobe is also a part of section 130 and fits within cavity 192. It will be appreciated that section 120 also contains a pair of lobes which are mirror images to the lobes of section 130 and offset by ninety degrees to them, being composed of hemispherical portions 160 and 160*a* respectively and their respective inwardly extending portions. The lobes of section 120 fit into a corresponding cavity in section 130. The two pairs of lobes are capable of moving relative to one another due to the slack created by the interlocking parts, the central shaft 122 running through the longitudinal length of the connector assembly, and the gap between the surface of each hemisphere and the body of the connector assembly. In the case of a preferred embodiment where the diameter of the connector assembly as shown by dimension "D" in FIG. 9 is approximately one and five eighths inches (for $\frac{3}{4}$ inch sucker rod), the diameter of the bottom of lobe 100 as shown by dimension "E" is approximately one and three eighths inches.

As a result of the design, the two hemispheres are interlocked so that the connector assembly is essentially of one piece construction but has two separate sections which can move relative to each other to thereby permit the connector assembly to adjust to various arcuate bends and dog-leg portions in the tubing string. The arcuate generally "S" shaped transverse ledges such as 146, 148, and 156 provide a substantial tensile force strength to counteract all of the longitudinal forces imparted to the connector assembly 110 and thereby prevent the two sections 120 and 130 from being pulled apart. The tops of the hemispheres provide substantial compression strength to prevent the two sections 120 and 130 from being compressed together. The vertical walls such as 142, 144, 154, 152 and 142*a* provide for significant rotational or torque strength to absorb the twisting and torsional forces imparted to the apparatus. The interlocking nature of the two internal hemispheres provides an assembly which permits the two sections to move in an arcuate manner relative to each other while at the same time distributing the lateral and torsional forces over the entire arcuate member and not permitting the forces to concentrate in one selected area. As a result, this present design eliminates a point of weakness location where the connector assembly can break.

Because of the hemispherical shape, the transverse ledges have more surface area on their outer side than in the center. Therefore, when pulling forces are exerted on the connector assembly, any shearing that may result will begin on the inside and this could lead to the two sections being pulled apart. The interlocking "S" shaped pattern of adjacent hemispheres and the further interlocking effect and rounded edges create by the arcuate generally "S" shaped transverse ledges tends to eliminate the shearing of the interior surface of the ledge and therefore tends to reduce the incidence of the two parts being pulled apart.

The central hole 122 is important to allow relative movement of the two sections and their respective lobes.

In experimental use, the present invention connector assembly 110 has been able to withstand fifty three tons of straight pull. In addition, the design has eliminated friction of the string of connector rods in the tubing string such that nearly twenty-four additional barrels of oil each day have been pumped from a well using the connector assembly 110 to interconnect sucker rods.

In an embodiment of the present invention, a number 10 wire was used for the EDM process. This created a gap of approximately 12/1000th of an inch between the hemisphere and the body of the connector assembly for each embodiment of the present invention. This combined with a hemispherical arc of approximately one inch radius enables the two sections 20 and 30 (or 120 and 130) to be rotated through an arc in the range of approximately 1 degrees to 3 degrees relative to each other. It is believed that this 12/1000th inch gap and approximately two inch length from the top of one hemisphere to the top of an adjacent hemisphere provides the optimum design for relative arcuate movement and strength. A thinner gap would create a smaller amount of arcuate movement and a larger distance between the tops of adjacent hemispheres with the same gap would also provide for a smaller amount of arcuate movement. A shorter distance between the top of adjacent hemispheres or a wider gap would serve to increase the relative arcuate movement but the strength of the connector assembly would be diminished.

It is also important to note that the arcuate design of the interconnecting lobes and their hemispheres eliminates stress points and parts where the connector assembly could fracture or shear. The invention therefore comprises a pair of interlocking pre-shaped lobes with arcuate surfaces to avoid stress points and evenly disposed neck and lobe members around the part to avoid a weak portion.

Also shown in FIGS. 3 and 4 are wrench flats 102 and 104 respectively. Wrench flats 202 and 204 are shown in FIGS. 7 and 8. The wrench flats are used to enable wrenches to tighten and/or loosen the connector assembly onto a sucker rod. The wrench flats are located in a conventional manner in conformity with API standards for placement of the wrench flats in relationship to the coupling.

In actual practice, the threaded end of a sucker rod is screwed into one of the threaded shafts or taped recesses 24 or 34 of the present invention connector assembly 10. As shown in FIG. 1, a connector assembly 10 will first have an internally threaded shaft 34 engaged by a threaded end of a pony rod 503 which in turn is connected to pull rod 502 and the upper internally threaded shaft 24 engaged by a threaded end portion of sucker rod 230. In similar fashion, sucker rods 222 and 211 are interconnected by a single connector assembly 10 by having the lower internally threaded shaft 34 engaged by the upper threaded end portion of sucker rod 222 and the upper internally threaded shaft 24 engaged by the lower threaded end portion of sucker rod 211. In similar fashion, the remaining pairs of sucker rods are interconnected by a connector assembly 10.

When the sucker rods 200, 210, 211, 220, 222 and 230 of sucker rod string 198 are reciprocated in the tubing string 300 that has the angularly disposed sections 302, 310, and 320, each of the connector assemblies 10 will have upper and lower sections 20 and 30 move angularly relative to one another as they negotiate this dog-leg or angulation in the tubing string 300. Such angular movement of the two sections of the connector assembly relative to each other is performed by the relative movement of the lobes and their respective hemispheres relative to one another within the constraints permitted by the gap between the sides of the lobes and the adjacent body of the connector assembly and the movement of the lobes relative to one another along their adjacent lateral faces.

As the sucker rod string 198 is reciprocated by movement of the polished rod 544, the upward longitudinal stress on sucker rod string 198 is transmitted through the upper sections 20 and lower sections 30 of each connector assembly 10, as shown in FIG. 1.

Similarly, the threaded end of a sucker rod is screwed into one of the threaded shafts or taped recesses 124 or 134 of the present invention connector assembly 110. As shown in FIG. 1, a connector assembly 110 (instead of 10) will first have an internally threaded shaft 134 engaged by a threaded end of a pony rod 503 which in turn is connected to pull rod 502 and the upper internally threaded shaft 124 engaged by a threaded end portion of sucker rod 230. In similar fashion, sucker rods 222 and 211 are interconnected by a single connector assembly 110 by having the lower internally threaded shaft 134 engaged by the upper threaded end portion of sucker rod 222 and the upper internally threaded shaft 124 engaged by the lower threaded end portion of sucker rod 211. In similar fashion, the remaining pairs of sucker rods are interconnected by a connector assembly 110.

When the sucker rods 200, 210, 211, 220, 222 and 230 of sucker rod string 198 are reciprocated in the tubing string 300 that has the angularly disposed sections 302, 310, and 320, each of the connector assemblies 10 will have upper and lower sections 20 and 30 move angularly relative to one another as they negotiate this dog-leg or angulation in the tubing string 300. Such angular movement of the two sections of the connector assembly relative to each other is performed by the relative movement of the lobes and their respective hemispheres relative to one another within the constraints permitted by the gap between the sides of the lobes and the adjacent body of the connector assembly and the movement of the lobes relative to one another along their adjacent lateral faces.

As the sucker rod string 198 is reciprocated by movement of the polished rod 544, the upward longitudinal stress on sucker rod string 198 is transmitted through the upper sections 120 and lower sections 130 of each connector assembly 110.

In the past, when sucker rods were connected by single boxes, the longitudinal stress imposed thereon on the upstroke and downstroke of the pumping operation caused substantial friction due to the lateral stress on the rods and boxes in the dog-leg or angulation areas in the tubing string. This resulted in additional loads being transferred through the polished rod and carrier bar of the actuating cable thereby causing additional wear on the pumping unit. However, when connector assemblies 10 are used to connect adjoining end portions of sucker rods in dog-leg areas as above described, each sucker rod as it is longitudinally stressed is free to move relative to the tubing string and the lateral stress is reduced resulting in reduced friction. In addition, the stress of one sucker rod to the sucker rod above and below it is significantly reduced. This significant reduction in friction enables the reciprocating portion of the pump to travel several additional inches on each stroke, thereby resulting in a significant increase in oil production. While the connector assembly described in U.S. Pat. No. 4,329,124 provides an overall similar result for a period of time, the design of that connector assembly created points where localized stress could build up (such as the location of internally threaded shank 30) and therefore connector assembly would break after a period of usage. The present invention connector assembly eliminates the localized stress points and absorbs the longitudinal, lateral and torsional loads imparted thereto without breaking.

By way of example, the present invention connector assembly 10 or 110 can be made of 300M metal which is comprised of a modified 4300 series carbon steel with a heat treat hardness of 42 Rockwell.

The Electro Discharge Machining (EDM) process employed in creating the present invention one piece connector assembly is a well known process. Concurrently with the filing of this Continuation-In-Part Application, the inventors submit advertising brochures from the following three companies which perform the EDM process:

(1) Swiss Wire E.D.M. 3505 Cadillac Avenue; Unit J1 Costa Mesa, Calif. 92626

(2) Adron Tool Corp. 12704 W. Arden Place Bulter, Wis. 53007 (As stated on the enclosed flyer, the company was established in 1969, showing that the EDM process was known at the time the parent application was filed)

(3) Wire Cut Company, Inc. 7286-C Melrose Street Buena Park, Calif. 90621.

Another company which was formed in 1986 by the late Ken Grubryn performs the EDM process work for the inventors. This company is named Wire Tech EDM, Inc. and is located in Los Alamitos, Calif. This statement is also supported by the accompanying declaration of the inventors.

Since the machine designs produced by the various manufacturers dictate different parameters for the wire cutting process used in EDM, the type of conductor used and the voltages and currents used will vary, depending on the particular machine. By way of illustration and not limitation, the inventors have used the following conductor: a wire created by Charmilles Technologies S.A., 109 Rue De Lyon CH-1211 Geneve 13; Wire SW25X 0.25 mm—Reference U.S. Pat. Nos. 4,341,939 and 4,287,404. The Voltage range used was 100 to 150 volts with the wire polarized negatively with respect to the part. The current used was in the range of 30 to 35 Amperes.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A connector assembly for use in so connecting adjacently disposed, longitudinally spaced, threaded end portions of sucker rods that the latter may be reciprocated in an oil well tubing string that has first and second angularly disposed sections, said connector assembly substantially reducing friction as said sucker rods are longitudinally stressed during concurrent reciprocation thereof, said connector assembly comprising:

a. a one-piece connector member comprising first and second interconnected longitudinal sections which can move relative to one another;

b. said first longitudinal section comprising a pair of oppositely disposed lobe members which extend into a cavity within said second longitudinal section;

c. said second longitudinal section comprising a pair of oppositely disposed lobe members which extend into a cavity within said first longitudinal section;

d. the lobes of said first longitudinal section being a mirror image of the lobes of the second longitudinal section and offset to them by approximately ninety degrees such that the lobes can move relative to each other but prevent separation of the first and second longitudinal sections; and e. each lobe being in the shape of a partial hemisphere with an arcuate surface and a generally "S" shaped lateral surface such that a portion of the lateral surface of a lobe from said first longitudinal section lies directly opposite a portion of the lateral surface of a lobe from said second longitudinal section;

f. wherein when longitudinal, lateral, torsional and frictional forces are imparted to the strings of sucker rod, the connector assembly can absorb longitudinal, lateral and rotational motion and reduce friction by virtue of the pair of lobes in the first longitudinal section moving relative to the pair of lobes in the second longitudinal section.

2. The connector assembly as defined in claim 1 wherein each of said lobes is generally hemispherical in outward cross-section and the cavity in which each lobe sits extends through the exterior lateral surface of the connector assembly.

3. The connector assembly as defined in claim 1 wherein the connector assembly further comprises a longitudinal shaft extending through the entire connector assembly.

4. The connector assembly as defined in claim 1 wherein the first section comprises an internal threaded shaft to accommodate a threaded end of one sucker rod and the second section comprises an internal threaded shaft to accommodate a threaded end of a second sucker rod so that the connector assembly can interconnect two adjacent sucker rods.

5. The connector assembly as defined in claim 1 further comprising a pair of oppositely disposed wrench flats on the surface of each of said two sections.

6. The connector assembly as defined in claim 1 wherein the connector assembly is made of 300M metal comprised of modified 4300 series carbon steel with a heat treat hardness of 42 Rockwell.

7. The connector assembly as defined in claim 1 wherein the connector assembly is made of 300M metal comprised of modified 4300 series carbon steel with a heat treat hardness of 42 Rockwell.

8. In combination with a tubing string that has an upper first portion and at least one lower second portion that extend downwardly in a bore hole to a fluid producing formation, said first and second portions angularly disposed to one another, said first and second portions having adjoining ends thereof connected to one another to define a junction; a pump disposed in said bore hole below said second portion and in communication therewith and with said fluid producing zone, said pump including a pull rod that extends upwardly therefrom and which when reciprocated causes said pump to discharge fluid from said formation upwardly into said lower second portion of said tubing; first and second strings of sucker rod of smaller external diameter than the interior diameter of said tubing movably disposed in said first and second portion, said first and second strings having adjacently disposed, longitudinally spaced threaded end portions adjacent to said junction; power means for reciprocating said upper string of sucker rod; a first connector assembly disposed in said tubing adjacent said junction that pivotally connects said first and second strings to permit said first means to reciprocate said first and second strings and said piston rod for said pump to discharge said fluid from said formation upwardly in said tubing, said connector assembly comprising:

a. a first section that has upper and lower ends, a first longitudinal internally threaded shaft that extends downwardly from said upper end and is engaged by said threaded end portion of said first sucker rod string;

b. a second section that has an upper end and a lower end, a second longitudinal internally threaded shaft that extends upwardly from said lower end and is engaged by said threaded end portion of said second sucker rod string;

c. the lower end of said first section comprising a pair of oppositely disposed lobe members which extend into a cavity within said second section;

d. the upper end of said second section comprising a pair of oppositely disposed lobe members which extend into a cavity within said first section;

e. each lobe being in the shape of a partial hemisphere with an arcuate surface and a generally "S" shaped lateral surface such that a portion of the lateral surface of a lobe from said first longitudinal section lies directly opposite a portion of the lateral surface of a lobe from said second longitudinal section; and f. the lobes of said first section being a mirror image of the lobes of the second section and offset to them by approximately ninety degrees such that the lobes interconnect the two sections so that they cannot be separated but permit relative movement of the sections.

9. A connector assembly for use in so connecting adjacently disposed, longitudinally spaced, threaded end portions of sucker rods that the latter may be reciprocated in an oil well tubing string that has first and second angularly disposed sections, said connector assembly substantially reducing friction as said sucker rods are longitudinally stressed during concurrent reciprocation thereof, said connector assembly comprising:

a. a one-piece connector member comprising first and second interconnected longitudinal sections which can move relative to one another;

b. said first longitudinal section comprising a pair of oppositely disposed lobe members which extend into a cavity within said second longitudinal section;

c. said second longitudinal section comprising a pair of oppositely disposed lobe members which extend into a cavity within said first longitudinal section;

d. the lobes of said first longitudinal section being a mirror image of the lobes of the second longitudinal section and offset to them by approximately ninety degrees such that the lobes can move relative to each other but prevent separation of the first and second longitudinal sections; and e. each lobe being in the shape of a partial hemisphere with an arcuate surface and a generally flat lateral surface such that a portion of the lateral surface of a lobe from said first longitudinal section lies directly opposite a portion of the lateral surface of a lobe from said second longitudinal section;

f. wherein when longitudinal, lateral, torsional and frictional forces are imparted to the string of sucker rod, the connector assembly can absorb longitudinal, lateral and rotational motion and reduce friction by virtue of the pair of lobes in the first longitudinal section moving relative to the pair of lobes in the second longitudinal section.

10. The connector assembly as defined in claim 9 wherein each of said lobes is generally hemispherical in outward cross-section and the cavity in which each lobe sits extends through the exterior lateral surface of the connector assembly.

11. The connector assembly as defined in claim 9 wherein the connector assembly further comprises a longitudinal shaft extending through the entire connector assembly.

12. The connector assembly as defined in claim 9 wherein the first section comprises an internal threaded shaft to accommodate a threaded end of one sucker rod and the second section comprises an internal threaded shaft to accommodate a threaded end of a second sucker rod so that the connector assembly can interconnect two adjacent sucker rods.

13. The connector assembly as defined in claim 9 further comprising a pair of oppositely disposed wrench flats on the surface of each of said two sections.

14. The connector assembly as defined in claim 9 wherein the conductor assembly is made of 300M metal comprised of modified 4300 series carbon steel with a heat treat hardness of 42 Rockwell.

15. In combination with a tubing string that has an upper first portion and at least one lower second portion that extend downwardly in a bore hole to a fluid producing formation, said first and second portions angularly disposed to one another, said first and second portions having adjoining ends thereof connnected to one another to define a junction; a pump disposed in said bore hole below said second portion and in communication therewith and with said fluid producing zone, said pump including a pull rod that extends upwardly therefrom and which when reciprocated causes said pump to discharge fluid from said formation upwardly into said lower second portion of said tubing; first and second strings of sucker rod of smaller external diameter than the interior diameter of said tubing movably disposed in said first and second portions, said first and second strings having adjacently disposed, longitudinally spaced threaded end portions adjacent to said junction; power means for reciprocating said upper string of sucker rod; a first connector assembly disposed in said tubing adjacent said junction that pivotally connects said first and second strings to permit said first means to reciprocate said first and second strings and said piston rod for said pump to discharge said fluid from said formation upwardly in said tubing, said connector assembly comprising:

a. a first section that has upper and lower ends, a first longitudinal internally threaded shaft that extends downwardly from said upper end and is engaged by said threaded end portion of said first sucker rod string;

b. a second section that has an upper end and a lower end, a second longitudinal internally threaded shaft that extends upwardly from said lower end and is engaged by said threaded end portion of said second sucker rod string;

c. the lower end of said first section comprising a pair of oppositely disposed lobe members which extend into a cavity within said second section;

d. the upper end of said second section comprising a pair of oppositely disposed lobe members which extend into a cavity within said first section;

e. each lobe being in the shape of a partial hemisphere with an arcuate surface and a generally flat lateral surface such that a portion of the lateral surface of a lobe from said first longitudinal section lies directly opposite a portion of the lateral surface of a lobe from said second longitudinal section; and f. the lobes of said first section being a mirror image of the lobes of the second section and offset to them by approximately ninety degrees such that the lobes interconnect the two sections so that they cannot be separated but permit relative movement of the sections.

16. A connector assembly for use in so connecting adjacently disposed, longitudinally spaced, threaded end portions of sucker rods that the latter may be reciprocated in an oil well tubing string that has first and second angularly disposed sections, said connector assembly substantially reducing friction as said sucker rods are longitudinally stressed during concurrent reciprocation thereof, said connector assembly comprising:

a. a one-piece connector member comprising first and second interconnected non-separable longitudinal sections which can move relative to one another;

b. said first longitudinal section comprising a pair of oppositely disposed lobe members which extend into a cavity within said second longitudinal section;

c. said second longitudinal section comprising a pair of oppositely disposed lobe members which extend into a cavity within said first longitudinal section; and d. the lobes of said first longitudinal section being a mirror image of the lobes of the second longitudinal section and offset to them by approximately ninety degrees such that the lobes can be relative to each other but prevent separation of the first and second longitudinal sections;

e. wherein when longitudinal, lateral, torsional and frictional forces are imparted to the strings of sucker rod, the connector assembly can absorb longitudinal, lateral and rotational motion and reduce friction by virtue of the pair of lobes in the first longitudinal section moving relative to the pair of lobes in the second longitudinal section.

17. The connector assembly as defined in claim 16 wherein each lobe being in the shape of a partial hemisphere with an arcuate surface and a generally "S" shaped lateral surface such that a portion of the lateral surface of a lobe from said first longitudinal section lies directly opposite a portion of the lateral surface of a lobe from said second longitudinal section.

18. The connector assembly as defined in claim 16 wherein each lobe being in the shape of a partial hemisphere with an arcuate surface and a generally flat lateral surface such that a portion of the lateral surface of a lobe from said first longitudinal section lies directly opposite a portion of the lateral surface of a lobe from said second longitudinal section.

19. The connector assembly as defined in claim 16 wherein each of said lobes is generally hemispherical in outward cross-section and the cavity in which each lobe sits extends through the exterior lateral surface of the connector assembly.

20. The connector assembly as defined in claim 16 wherein the connector assembly further comprises a longitudinal shaft extending through the entire connector assembly.

21. The connector assembly as defined in claim 16 wherein the first section comprises an internal threaded shaft to accommodate a threaded end of one sucker rod and the second section comprises an internal threaded shaft to accommodate a threaded end of a second sucker rod so that the connector assembly can interconnect two adjacent sucker rods.

22. The connector assembly as defined in claim 16 further comprising a pair of oppositely disposed wrench flats on the surface of each of said two sections.

23. In combination with a tubing string that has an upper first portion andd at least one lower second portion that extend downwardly in a bore hole to a fluid producing formation, said first and second portions angularly disposed to one another, said first and second portions having adjoining ends thereof connected to one another to define a junction; a pump disposed in said bore hole below said second portion and in communication therewith and with said fluid producing zone, said pump including a pull rod that extends upwardly therefrom and which when reciprocated causes said pump to discharge fluid from said formation upwardly into said lower second portion of said tubing; first and second strings of sucker rod of smaller external diameter than the interior diameter of said tubing movably disposed in said first and second portions, said first and second strings having adjacently disposed, longitudinally spaced threaded end portions adjacent to said junction; power means for reciprocating said upper string of sucker rod; a first connector assembly disposed in said tubing adjacent said junction that pivotally connects said first and second strings to permit said first means to reciprocate said first and second strings and said piston rod for said pump to discharge said fluid from said formation upwardly in said tubing, said connector assembly comprising:

a. a first section that has upper and lower ends, a first longitudinal internally threaded shaft that extends downwardly from said upper end and is engaged by said threaded end portion of said first sucker rod string;

b. a second section that has an upper end and a lower end, a second longitudinal internally threaded shaft that extends upwardly from said lower end and is engaged by said threaded end portion of said second sucker rod string;

c. the lower end of said first section comprising a pair of oppositely disposed lobe members which extend into a cavity within said second section;

d. the upper end of said second section comprising a pair of oppositely disposed lobe members which extend into a cavity within said first section; and e. the lobes of said first section being a mirror image by the lobes of the second section and offset to them by approximately ninety degrees such that the lobes interconnect the two sections so that they cannot be separated but permit relative movement of the sections.

24. The invention as defined in claim 23 wherein each lobe is in the shape of a partial hemisphere with an arcuate surface and a generally "S" shaped lateral surface such that a portion of the lateral surface of a lobe from said first longitudinal section lies directly opposite a portion of the lateral surface of a lobe from said second longitudinal section.

25. The invention as defined in claim 23 wherein each lobe is in the shape of a partial hemisphere with an arcuate surface and a generally flat lateral surface such that a portion of the lateral surface of a lobe from said first longitudinal section lies directly opposite a portion of the lateral surface of a lobe from said second longitudinal section.

* * * * *